US011569002B2

(12) United States Patent
Park et al.

(10) Patent No.: US 11,569,002 B2
(45) **Date of Patent: *Jan. 31, 2023**

(54) TRANSFER CASK FOR SPENT NUCLEAR FUEL

(71) Applicant: KEPCO ENGINEERING & CONSTRUCTION COMPANY, INC., Gimcheon-si (KR)

(72) Inventors: Jin Seok Park, Sejong-si (KR); Soung Kyu Lee, Daejeon (KR); Sung Hwan Kim, Sejong-si (KR); Kwang Jeok Ko, Daejeon (KR); Min Gyu Kim, Daejeon (KR); Yeon Ho Cho, Daejeon (KR)

(73) Assignee: KEPCO ENGINEERING & CONSTRUCTION COMPANY, INC., Gyeongsangbuk-do (KR)

( * ) Notice: Subject to any disclaimer, the term of this patent is extended or adjusted under 35 U.S.C. 154(b) by 293 days.

This patent is subject to a terminal disclaimer.

(21) Appl. No.: 16/997,434

(22) Filed: Aug. 19, 2020

(65) Prior Publication Data

US 2021/0057119 A1 Feb. 25, 2021

(30) Foreign Application Priority Data

Aug. 21, 2019 (KR) ..... 10-2019-0102512

(51) Int. Cl.
*G21F 5/00* (2006.01)
*G21F 5/06* (2006.01)
(Continued)

(52) U.S. Cl.
CPC ..... *G21F 5/008* (2013.01); *G21F 5/065* (2013.01); *G21F 5/12* (2013.01)

(58) Field of Classification Search
CPC ..... G21F 5/008; G21F 5/065; G21F 5/12
(Continued)

(56) References Cited

U.S. PATENT DOCUMENTS

2003/0194042 A1 10/2003 Singh et al.
2021/0098145 A1* 4/2021 Park ..... G21F 5/008

FOREIGN PATENT DOCUMENTS

KR 10-1559300 B1 11/2015

OTHER PUBLICATIONS

Korean Office Action (Application No. 10-2019-0102512) dated Sep. 18, 2020.

* cited by examiner

*Primary Examiner* — Nicole M Ippolito
(74) *Attorney, Agent, or Firm* — Nixon Peabody LLP; Jeffrey L. Costellia

(57) ABSTRACT

The present disclosure relates to a transfer cask for transferring spent nuclear fuel. The transfer cask transfers a canister storing the spent nuclear fuel and includes a transfer container having a space for accommodating the canister; a neutron shielding body arranged on an outer periphery of the transfer container to shield neutrons; and an opening/closing portion that is coupled to a lower portion of the transfer container and opens and closes the lower portion of the transfer container, wherein the opening and closing portion, a support portion supporting the transfer container and having a first through hole in communication with the transfer container; a lid assembly having a first lid portion and a second lid portion that open and close the first through hole; and a base plate on which the support portion is seated and a second through hole through which the canister is drawn out is formed.

7 Claims, 7 Drawing Sheets

(51) Int. Cl.
*G21F 5/12* (2006.01)
*G21F 5/008* (2006.01)

(58) Field of Classification Search
USPC ..... 250/505.1, 506.1, 507.1, 515.1, 516.1, 250/517.1, 518.1, 519.1
See application file for complete search history.

TRANSFER CASK FOR SPENT NUCLEAR FUEL

CROSS-REFERENCE TO RELATED APPLICATION

This application claims the benefit of Korean Patent Application No. 10-2019-0102512, filed on Aug. 21, 2019, in the Korean Intellectual Property Office, the disclosure of which is incorporated herein in its entirety by reference.

BACKGROUND

1. Field

The present disclosure relates to a transfer cask for spent nuclear fuel, and particularly, to a transfer cask for spent nuclear fuel that is easily installed and moved by reducing the weight and volume thereof and simplifies a transfer procedure of spent nuclear fuel.

2. Description of Related Art

FIG. 1 schematically illustrates a work procedure for moving spent nuclear fuel by using a transfer cask. FIG. 1A illustrates an initial situation before the spent nuclear fuel is transferred. A canister 2 in which the spent nuclear fuel is stored is located with an upper lid opened at a lower portion of a work table 1. The spent nuclear fuel remains sealed in the canister 2.

Subsequently, a temporary shielding body 3, a transfer collar 4, a lid opening/closing apparatus 5, and a lower lid assembly 6 are installed as illustrated in FIGS. 1B to 1E. An actuator 7 opens lower lids 9 of the lower lid assembly 6 which are formed of two square plates by moving the lower lids 9 in opposite directions to each other.

Subsequently, a lifting apparatus connected to a crane is connected to a lifting adapter 2*a* installed on an upper portion of the canister 2 to take out the canister 2 into the transfer cask 8, and then the actuator 7 operates to close the lower lid 9. Through a series of the processes, moving the canister 2 into the transfer cask 8 is completed. Subsequently, a process of transferring the transfer cask 8 to a position of a storage cask that is used only for storing spent nuclear fuel.

However, as described above, in the process of transferring the canister 2, the transfer collar 4, the lid opening/closing apparatus 5, the lower lid 9, and so on have to be designed and installed separately, and thus, there is a disadvantage in that a work time is taken too much and the procedure is complicated. In addition, if much work time is taken because of a complicated procedure, there is a problem that a possibility of radiation exposure to a worker increases.

SUMMARY

The present disclosure provides a transfer cask for spent nuclear fuel that is easily installed and moved by reducing the weight and volume thereof to simplify a transfer procedure of spent nuclear fuel.

Additional aspects will be set forth in part in the description which follows and, in part, will be apparent from the description, or may be learned by practice of the presented embodiments of the disclosure.

Provided is a transfer cask for spent nuclear fuel, the transfer cask transferring a canister storing the spent nuclear fuel and including a transfer container having a space for accommodating the canister; a neutron shielding body arranged on an outer periphery of the transfer container to shield neutrons; and an opening/closing portion that is coupled to a lower portion of the transfer container and opens and closes the lower portion of the transfer container, wherein the opening/closing portion includes a support portion which supports the transfer container and in which the lower portion of the transfer container is placed and a first through-hole communicating with the transfer container is formed; a base plate on which the support portion is placed and in which a second through-hole through which the canister passes is formed; and a lid assembly having a first lid portion that opens and closes part of the first through-hole by rotating a first lid around a first rotation axis, and a second lid portion that opens and closes a remaining portion of the first through-hole by rotating a second lid around a second rotation axis.

In addition, each of the first lid and the second lid may be formed in a semicircular shape, and when the first and second lids are closed, the first and second lids may form a circular shape, the first lid portion may include a first actuator having an end of a rod coupled to an outer edge of the first lid and a rod body coupled to the base plate, the second lid portion may include a second actuator having an end of a od coupled to an outer edge of the second lid and a rod body coupled to the base plate, and the first and second through-holes may be opened by rotating the first and second lids away from each other and may be closed by rotating the first and second lids to be closer to each other.

In addition, a protrusion portion may be formed to protrude in an end of the first lid, a placement portion on which the protrusion portion is placed may be formed on the second lid, and the protrusion portion may be placed on the placement portion having a stepped shape to close the first through-hole.

In addition, the rod body of the first actuator may be rotatable around a third rotation shaft, and the rod body of the second actuator may be rotatable around a fourth rotation shaft.

In addition, the support portion may include an upper support portion on which the lower portion of the transfer container is placed; and a lower support portion that is spaced apart from the upper support portion at a certain distance and is detachably coupled to the base plate, and the lid assembly may move between the upper support portion and the lower support portion.

In addition, edges of the upper support portion and edges of the lower support portion may be coupled to each other by coupling pins having a certain height, and part of the coupling pins comes into contact with the lid assembly to restrict movement of the lid assembly when the lid assembly opens the first and second through-holes.

In addition, the first lid portion may include the first lid formed in a semicircular shape, a first rotation arm portion having both ends extending in directions opposite to each other about the first rotation shaft and having one of the both ends coupled to the first lid, and a first actuator having an end of a rod rotatably coupled to the other end of the first rotation arm portion, and when the first lid closes the first through-hole, an angle between a first virtual line formed by extending the rod of the first actuator and a second virtual line formed by extending the first rotation arm portion may be 90° or less, and when the first lid opens the first through-hole, the angle between the first virtual line and the second virtual line may be greater than 90°, and the second lid portion may include a second lid formed in a semicircular shape, and a second rotation arm portion having both ends extending in directions opposite to each other about the second rotation shaft and having one of the both ends coupled to the second lid, and a second actuator having an end of a rod rotatably coupled to the other end of the second rotation arm portion, and when the second lid closes the first through-hole, an angle between a third virtual line formed by extending the rod of the second actuator and a fourth virtual line formed by extending the second rotation arm portion may be 90° or less, and when the second lid opens the first through-hole, the angle between the third virtual line and the fourth virtual line may be greater than 90°.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
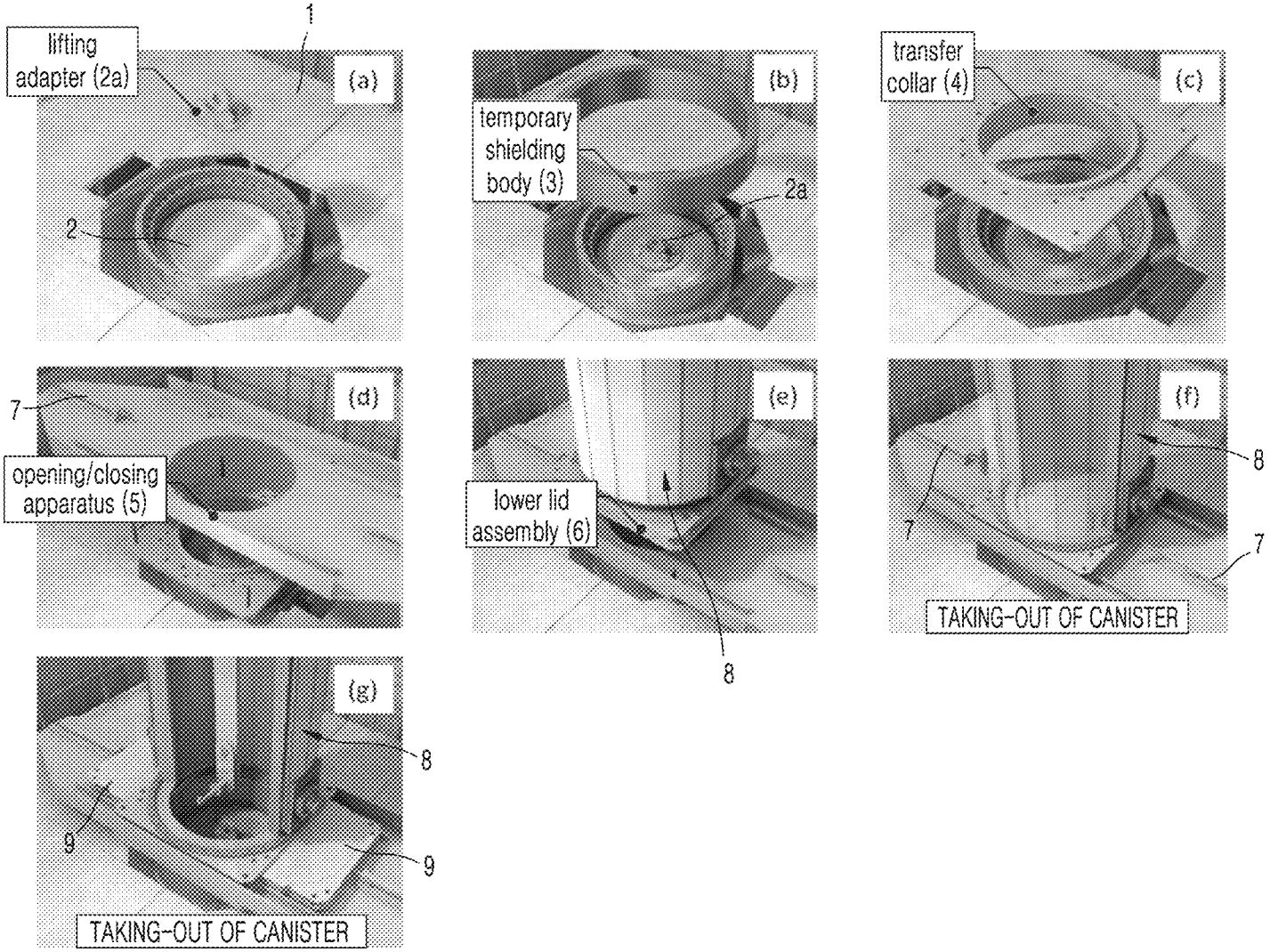
FIG. 1 is a view illustrating an installation process of a transfer cask of the related art.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, preferred embodiments according to the present disclosure will be described in detail with reference to the accompanying drawings.

Figure 2:
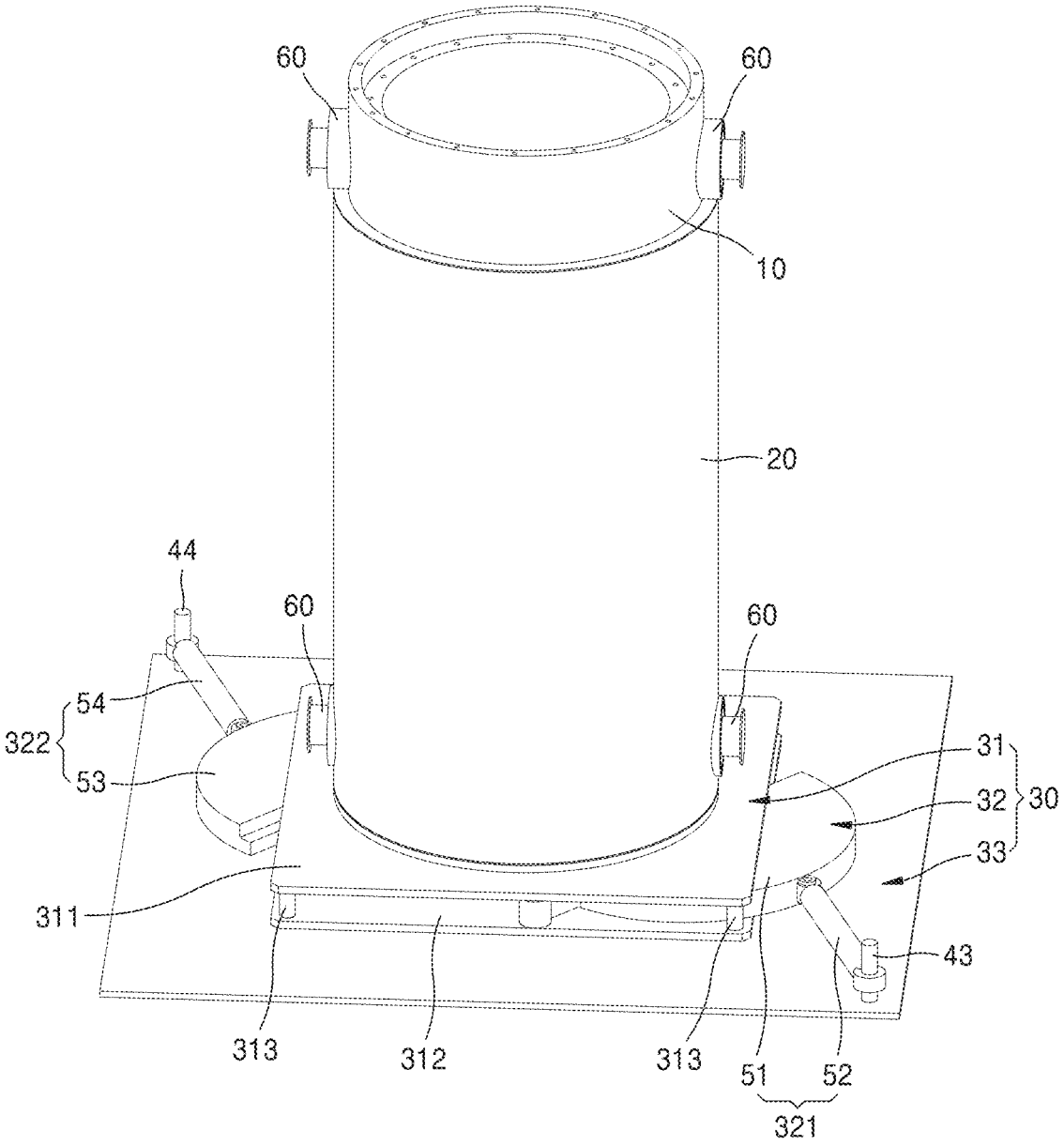
FIG. 2 is a perspective view of a transfer cask for spent nuclear fuel according to an embodiment of the present disclosure.
Figure 3:
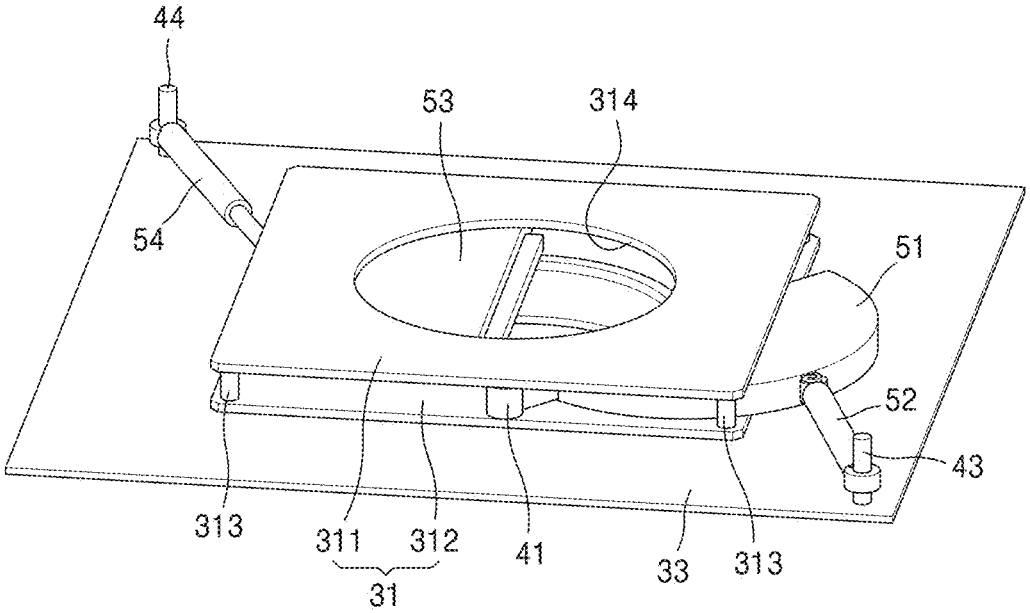
FIG. 3 is a perspective view of a main portion of FIG. 2.
Figure 4:
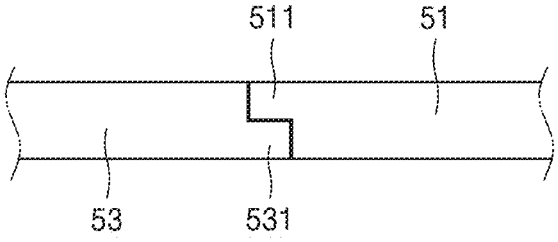
FIG. 4 is a cross-sectional view of closed first and second lids.
Figure 5:
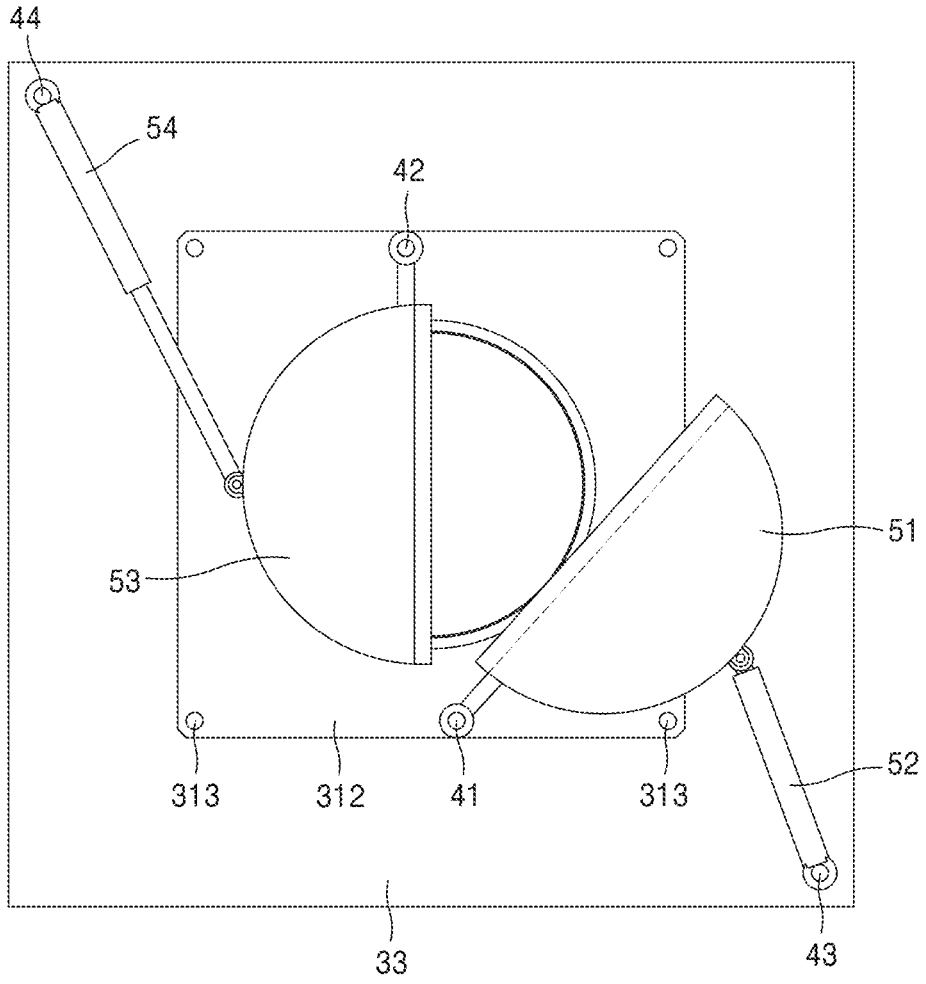
FIG. 5 is a plan view of FIG. 2.
Figure 6:
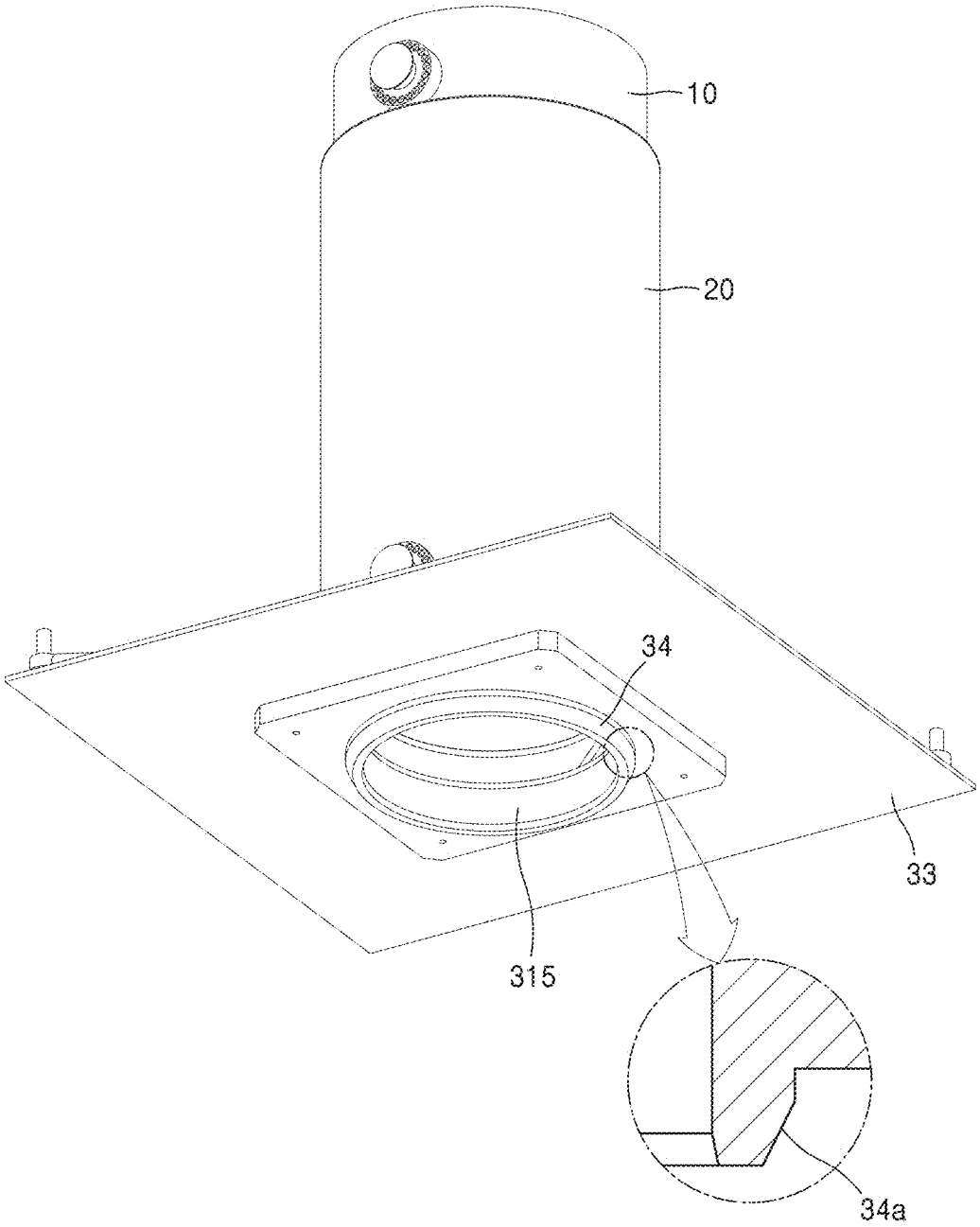
FIG. 6 is a bottom view of FIG. 2.

FIG. 2 is a perspective view of a transfer cask for spent nuclear fuel according to an embodiment of the present disclosure, and FIG. 3 is a perspective view of a main portion of FIG. 2. FIG. 4 is a cross-sectional view of closed first and second lids, FIG. 5 is a plan view of FIG. 2, and FIG. 6 is a bottom view of FIG. 6.

The present disclosure relates to a transfer cask used to transfer a canister storing spent nuclear fuel. The transfer cask according to an embodiment of the present disclosure includes a transfer container 10, a neutron shielding body 20, and an opening/closing portion 30.

As illustrated in FIG. 2, the transfer container 10 has a space for accommodating a canister. According to the present embodiment, upper and lower portions of the transfer container 10 are formed in a cylindrical shape in an open state. According to the present embodiment, the transfer container 10 is made of steel.

The opening/closing portion 30, which will be described later, is coupled to a lower portion of the transfer container 10, and an upper lid (not illustrated) may be coupled to an upper portion thereof. Two trunnions 60 are coupled to upper and lower sides of the transfer container 10, respectively. The trunnion is provided for coupling of the lifting apparatus. The lower trunnion 60 is required for horizontal lifting and may be omitted when there is no horizontal lifting in a work process.

The neutron shielding body 20 is provided to prevent neutrons emitted from the spent nuclear fuel contained in the canister from being emitted to the outside. According to the present embodiment, the neutron shielding body 20 is disposed around an outer periphery of the transfer container 10 to shield neutrons.

The neutron shielding body 20 may be implemented in a form in which a water jacket containing water is composed to surround the transfer container 10 or an epoxy resin (Epoxy-Resin or NS-4-FR) is included in an inner space of an outer wall spaced apart at a certain distance from an outer circumferential surface of the transfer container 10. The neutron shielding body 20 is also not limited to the form described above.

The opening/closing portion 30 is coupled to a lower portion of the transfer container 10 and is provided to open and close the lower portion of the transfer container 10. According to the present embodiment, the opening/closing portion 30 includes a support portion 31, a base plate 33, and a lid assembly 32.

The support portion 31 supports the transfer container 10. The lower portion of the transfer container 10 is placed on the support portion 31, and a first through-hole 314 communicating with the transfer container 10 is formed in the support portion 31. According to the present embodiment, the support portion 31 is coupled to the transfer container 10 by a method such as bolting or welding. The support portion 31 may be moved to an installation space together with the transfer container 10.

As illustrated in FIG. 3, according to the present embodiment, the support portion 31 includes an upper support portion 311 and a lower support portion 312.

The upper support portion 311 is a portion on which the lower portion of the transfer container 10 is placed. According to the present embodiment, the upper support portion 311 is formed in a square, and the first through-hole 314 is formed in the center thereof. The shape of the upper support portion 311 is also not limited to the square.

The lower support portion 312 is spaced apart from the upper support portion 311 by a certain distance and is detachably coupled to the base plate 33. According to the present embodiment, the lower support portion 312 is formed in a square corresponding to the upper support portion 311, and the first through-hole 314 is formed in the center thereof. A shape of the lower support portion 312 is also not limited to the square. A gap between the lower support portion 312 and the upper support portion 311 is provided as a space where the lid assembly 32 which will be described below may be moved in a space therebetween.

The base plate 33 is provided to place the support portion 31 thereon and to install actuators 52, 54. The base plate 33 is formed with a second through-hole 315 through which the canister that is taken out passes. a size of the second through-hole 315 is substantially the same as a size of the first through-hole 314, and the second through-hole 315 is provided below the first through-hole 314.

According to the present embodiment, the base plate 33 is formed in a square larger than sizes of the upper support portion 311 and the lower support portion 312. The shape of the base plate 33 is also not limited thereto.

Referring to FIGS. 3 and 5, the lid assembly 32 is provided to open and close the lower portion of the transfer container 10 and includes a first lid portion 321 and a second lid portion 322.

The first lid portion 321 is provided to open and close part of the first through-hole 314 by rotating the first lid 51 around a first rotation shaft 41. According to the present embodiment, the first rotation shaft 41 is provided on the lower support portion 312. A position of the first rotation shaft 41 is also not limited to the above-described position. The first lid 51 is formed in a semicircular shape and rotates around the first rotation shaft 41, and a protrusion portion 511 is formed to protrude in an end of the first lid 51.

The first lid portion 321 includes the first actuator 52. In the first actuator 52, an end of a rod is coupled to an outer edge of the first lid 51, a rod body is coupled to the base plate 33, and thus, the first lid 51 rotates around the first rotation shaft 41 when the rod is extended and compressed. The rod body of the first actuator 52 is rotatably coupled to a third rotation shaft 43. According to the present embodiment, the third rotation shaft 43 is provided on the base plate 33. However, when the base plate 33 is operated in a separation type as necessary, the first actuator 52 is separated from the first lid 51 and coupled to the base plate 33 when the transfer cask 8 is lifted, and only the support portion 31, the first lid 51, and the transfer container 10 may be lifted.

The second lid portion 322 is provided to open and close the remaining portion of the first through-hole 314 by rotating the second lid 53 around the second rotation shaft 42. In the present embodiment, the second rotation shaft 42 is provided on the lower support portion 312. The second rotation shaft 42 is arranged to face the first rotation shaft 41 about the first through-hole 314. A position of the second rotation shaft 42 is also not limited to the above-described position.

The second lid 53 is formed in a semicircular shape and has a circular shape together with the first lid 51. The second lid 53 is formed with a placement portion 531 on which the protrusion portion 511 is placed. As illustrated in FIG. 4, the protrusion portion 511 is placed on the placement portion 531 having a stepped shape to close the first through-hole 314.

The second lid portion 322 includes a second actuator 54. In the second actuator 54, an end of a rod is coupled to an outer edge of the second lid 53, a rod body is coupled to the base plate 33, and thus, the second lid 53 rotates around the second rotation shaft 42 when the rod is extended and compressed. However, when the base plate 33 is operated in a separation type as necessary, the second actuator 54 is separated from the second lid 53 and coupled to the base plate 33 when the transfer cask 8 is lifted, and only the support portion 31, the second lid 53, and the transfer container 10 may be lifted.

The rod body of the second actuator 54 is rotatably coupled to a fourth rotation shaft 44. In the present embodiment, the fourth rotation shaft 44 is provided on the base plate 33. The third shaft 43 and the fourth rotation shaft 44 are arranged at a diagonal corner on the base plate 33, respectively. The installation of the third and fourth rotation shafts 43 and 44 is not limited thereto.

As described above, the first and second through-holes 314 and 315 are opened as the first and second lids 51 and 53 are rotated away from each other by the first and second actuators 52 and 54 and are closed as the first and second lids 51 and 53 are rotated to be closer to each other by the first and second actuators 52 and 54.

According to the present embodiment, the upper support portion 311 and the lower support portion 312 are coupled to each other by coupling pins 313. Specifically, the coupling pins 313 having a certain height are arranged at edges of the upper support portion 311 and the lower support portion 312 to separate the upper support portion 311 and the lower support portion 312 by a certain height. According to the present embodiment, the upper support portion 311 and the lower support portion 312 are formed in a square, and the coupling pins 313 are arranged at each corner.

When the lid assembly 32 opens the first and second through-holes 314 and 315, part of the coupling pins 313 come into contact with the lid assembly 32 to restrict movement of the first and second lids 51 and 53. As illustrated in FIGS. 3 and 5, when the first lid 51 rotates around the first rotation shaft 41 to open the first and second through-holes 314 and 315, an opening range of the first lid 51 is limited to when the first lid 51 is stopped by the coupling pin 313. For reference, FIG. 5 is a plan view illustrating a state in which the upper support 311 is removed.

An opening range of the second lid 53 is also limited by the coupling pin 313 located diagonally to the coupling pin 313 restricting the opening range of the first lid 51. As such, the first and second lids 51 and 53 are prevented from being unnecessarily opened by the coupling pins 313 limiting the moving ranges of the first and second lids 51 and 53.

FIG. 6 illustrates a bottom surface of a transfer cask according to an embodiment of the present disclosure.

As illustrated in FIG. 6, an insertion portion 34 protruding downward is formed on a bottom surface of the base plate 33. An outer surface of the insertion portion 34 is provided with a slope surface 34*a*. When a transport cask according to the present disclosure is installed in a transport cask in which the canister is temporarily accommodated, the insertion portion 34 may be easily inserted into an upper side of the transport cask by the slope surface 34*a*, and the insertion portion 34 is formed to have a certain height, and thus, the insertion portion 34 serves as a transfer collar required when a transfer cask of related art is installed.

Hereinafter, actions and effects of a transfer cask for spent nuclear fuel according to the above-described configuration will be described in detail.

According to an embodiment of the present disclosure, a transport collar, a lid opening/closing apparatus, and a lower lid (see FIG. 1) of related art are integrated into the opening/closing portion 30 described above and are coupled to a lower portion of the transfer container 10. The transfer cask according to the embodiment of the present disclosure is moved to an upper side of a canister by using a lifting apparatus, and the opening/closing portion 30 is inserted into the transport cask. At this time, an insertion portion 34 formed on a lower side of the base plate 33 is inserted into an upper portion of the transport cask.

Subsequently, the first and second lids 51 and 53 are opened by the first and second actuators 52 and 54, a lifting apparatus is connected to the lifting adapter 2*a* provided in a canister, and the canister is pulled up into the transfer container 10. When the canister is accommodated in the transfer container 10, the first and second lids 51 and 53 are closed by using the first and second actuators 52 and 54, an upper lid (not illustrated) of the transfer container 10 is covered to close an upper portion, and thereafter, the transfer cask moved to a targeted storage location.

As such, in the transfer cask for spent nuclear fuel according to the present disclosure, the base plate 33 has a minimum area in which the first through-hole 314 is opened by forming the first and second lids 51 and 53 in a semicircular shape and rotating the first and second lids 51 and 53 around the first and second rotation shafts 41 and 42, and thus, weight and volume of the opening/closing portion 30 may be minimized.

By reducing the weight and volume of the transfer cask, the transfer container 10 coupled to the opening/closing portion 30 may be moved to the lifting apparatus at one time, and thus, there is effects that work time is reduced when the canister is moved and the amount of radiation exposure of an operator is reduced.

Figure 7:
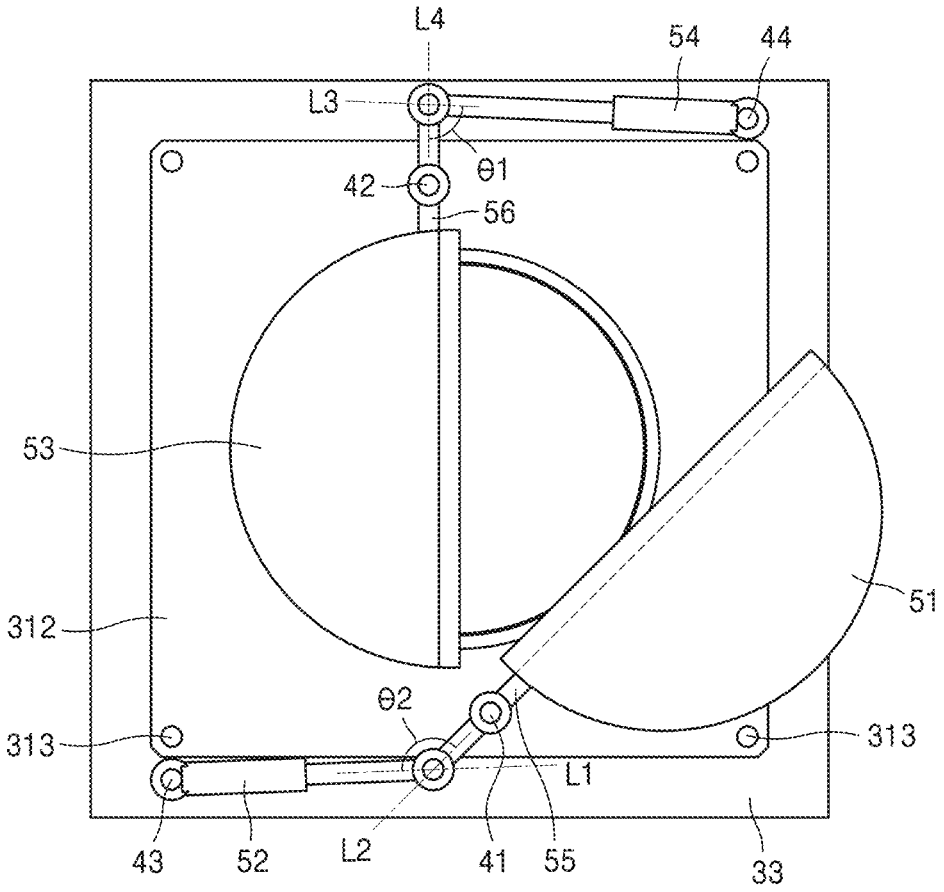
FIG. 7 is a view illustrating a lid assembly applied to a transfer cask for spent nuclear fuel according to another embodiment of the present disclosure.

Furthermore, FIG. 7 is a view illustrating a lid assembly 32 applied to a transfer cask for spent nuclear fuel according to another embodiment of the present disclosure.

According to the embodiment of FIG. 7, a configuration of the lid assembly is different from the lid assembly 32 according to the embodiment of FIG. 2. The embodiment of FIG. 7 may employ configurations of the transfer container 10, the neutron shielding body 20, and the support portion 31 as it is, and the lid assembly 32 constituting a support portion 31 may be implemented in the form illustrated in FIG. 7. The support portion 31 includes a upper support portion 311 and a lower support portion 312, and for the sake of convenience, FIG. 7 is a plan view illustrating a state in which the upper support portion 311 is removed.

According to the present embodiment, the lid assembly 32 includes a first lid portion 321 and a second lid portion 322. The first lid portion 321 includes a first lid 51, a first rotation arm portion 55, and a first actuator 52, and the second lid portion 322 includes a second lid 53, a second rotation arm portion 56, and a second actuator 54.

The first lid 51 of the first lid portion 321 is formed in a semicircular shape and is rotatable around the first rotation shaft 41. The first lid portion 321 is formed with a protrusion portion 511 as in the embodiment of FIG. 2.

Both ends of the first rotation arm portions 55 extend in opposite directions to each other about the first rotation shaft 41. That is, one end of the first rotation arm portion 55 extends in one direction about the first rotation shaft 41, and the other end thereof extends in the direction opposite to the one direction. One end of the first rotation arm portion 55 is coupled to the first lid 51.

The first actuator 52 is provided to rotate the first lid 51, and an end of a rod of the first actuator 52 is rotatably coupled to the other end of the first rotation arm portion 55.

A rod body of the first actuator 52 is arranged side by side with one side of the support portion 31 formed in a square. The rod body of the first actuator 52 is coupled to be rotated somewhat by a third rotation shaft 43.

When a virtual line formed by extending the rod of the first actuator 52 is referred to as a first virtual line L1 and a virtual line in a direction in which the first rotation arm portion 55 is extended is a second virtual line L2, an angle between the first virtual line L1 and the second virtual line L2 is 90° or less when the first lid 51 closes the first through-hole 314, and an angle between the first virtual line L1 and the second virtual line L2 is greater than 90° when the first lid 51 opens the first through-hole 314.

FIG. 7 illustrates a state in which the first lid 51 is opened. Referring to the FIG. 7, an angle the first virtual line L1 and the second virtual line L2 is greater than 90°. In addition, although FIG. 7 illustrates that the second lid 53 is in a closed state, when the first lid 51 is closed, the angle between the first virtual line L1 and the second virtual line L2 is less than 90° in the same manner as the first lid 51.

Furthermore, the second lid portion 322 is constituted similarly to the first lid portion 321.

The second lid 53 of the second lid portion 322 is formed in a semicircular shape and is rotatable around the second rotation shaft 42. The second lid portion 322 is formed with a placement portion 531 as in the embodiment of FIG. 2. When the first and second lid portions 321 and 322 close the first through-hole 314, the protrusion portion 511 of the first lid portion 321 is placed on the placement portion 531 of the second lid portion 322.

both ends of the second rotation arm portion 56 extend in opposite directions to each other about the second rotation shaft 42. That is, one end of the second rotation arm portion 56 extends in one direction about the second rotation shaft 42 and the other end thereof extends in a direction opposite to the one direction. One end of the first rotation arm portion 55 is coupled to the second lid 53.

The second actuator 54 is provided to rotate the second lid 53, and an end of the rod of the second actuator 54 is rotatably coupled to the other end of the second rotation arm portion 56.

A rod body of the second actuator 54 is arranged side by side with one side of the support portion 31 formed in a square. The rod body of the second actuator 54 is coupled to be rotated somewhat by the fourth rotation shaft 44. The third and fourth rotation shafts 43 and 44 are arranged to face each other in a diagonal direction substantially with respect to the base plate 33.

When a virtual line formed by extending the rod of the second actuator 54 is referred to as a third virtual line L3 and a virtual line in a direction in which the second rotation arm portion 56 is extended is a fourth virtual line L4, an angle between the third virtual line L3 and the fourth virtual line L4 is 90° or less when the second lid 53 closes the first through-hole 314, and an angle between the third virtual line L3 and the fourth virtual line L4 is greater than 90° when the second lid 53 opens the first through-hole 314.

FIG. 7 illustrates a state in which the second lid 53 is closed. Referring to FIG. 7, the angle between the third virtual line L3 and the fourth virtual line L4 is less than 90°. In addition, although FIG. 7 illustrates that the first lid 51 is in an open state, when the second lid 53 is closed, the angel between the third virtual line L3 and the fourth virtual line L4 is greater than 90° in the same manner as the second lid 53.

As described above, by arranging the first and second lids 51 and 53, the first and second actuators 52 and 54, and the first and second rotation arm portions 55 and 56, a size of the base plate 33 is substantially reduced. That is, by arranging the first and second actuators 52 and 54 substantially parallel to one side of the support portion 31, a space required to install the first and second actuators 52 and 54 may be reduced, and as a result, an effect of reducing volume and weight of a transfer cask according to the present disclosure is obtained.

Therefore, it is possible to obtain an effect of easily moving and installing the transfer cask even when the support portion 31 and the base plate 33 are coupled to a lower portion of the transfer container 10 because the weight and volume of the transfer cask are reduced. In addition, it is possible to obtain the same effect according to the embodiment of FIG. 2 because the embodiment of FIG. 7 also reduces the weight and volume of the transfer cask.

A transfer cask for spent nuclear fuel according to an embodiment of the present disclosure provides an effect of simplifying installation and movement by reducing weight and volume and of simplifying a transfer procedure for spent nuclear fuel.

In addition, an opening/closing portion that opens and closes a lower portion of a transfer container is integrally manufactured with the transfer container to simplify a work procedure at the time of moving a canister, and thus, it is possible to obtain an effect of reducing an operation time and reducing the amount of exposure of an operator.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A transfer cask for transferring a canister storing spent nuclear fuel, the transfer cask comprising:

a transfer container having a space for accommodating the canister;

a neutron shielding body arranged on an outer periphery of the transfer container to shield neutrons; and an opening/closing portion that is coupled to a lower portion of the transfer container and opens and closes the lower portion of the transfer container, wherein the opening/closing portion comprises:

a support portion which supports the transfer container and in which the lower portion of the transfer container is placed and a first through-hole communicating with the transfer container is formed;

a base plate on which the support portion is placed and in which a second through-hole through which the canister passes is formed; and a lid assembly having a first lid portion that opens and closes part of the first through-hole by rotating a first lid around a first rotation axis, and a second lid portion that opens and closes a remaining portion of the first through-hole by rotating a second lid around a second rotation axis.

2. The transfer cask of claim 1, wherein each of the first lid and the second lid is formed in a semicircular shape, and when the first and second lids are closed, the first and second lids form a circular shape, wherein the first lid portion includes a first actuator having an end of a rod coupled to an outer edge of the first lid and a rod body coupled to the base plate, wherein the second lid portion includes a second actuator having an end of a rod coupled to an outer edge of the second lid and a rod body coupled to the base plate, and wherein the first and second through-holes are opened by rotating the first and second lids away from each other and are closed by rotating the first and second lids to be closer to each other.

3. The transfer cask of claim 2, wherein a protrusion portion is formed to protrude in an end of the first lid, a placement portion on which the protrusion portion is placed is formed on the second lid, and the protrusion portion is placed on the placement portion having a stepped shape to close the first through-hole.

4. The transfer cask of claim 2, wherein the rod body of the first actuator is rotatable around a third rotation shaft, and wherein the rod body of the second actuator is rotatable around a fourth rotation shaft.

5. The transfer cask of claim 1, wherein the support portion comprises:

an upper support portion on which the lower portion of the transfer container is placed; and a lower support portion that is spaced apart from the upper support portion at a certain distance and is detachably coupled to the base plate, and wherein the lid assembly moves between the upper support portion and the lower support portion.

6. The transfer cask of claim 5, wherein edges of the upper support portion and edges of the lower support portion are coupled to each other by coupling pins having a certain height, and part of the coupling pins comes into contact with the lid assembly to restrict movement of the lid assembly when the lid assembly opens the first and second through-holes.

7. The transfer cask of claim 1, wherein the first lid portion includes the first lid formed in a semicircular shape, a first rotation arm portion having both ends extending in directions opposite to each other about the first rotation shaft and having one of the both ends coupled to the first lid, and a first actuator having an end of a rod rotatably coupled to the other end of the first rotation arm portion, wherein, when the first lid closes the first through-hole, an angle between a first virtual line formed by extending the rod of the first actuator and a second virtual line formed by extending the first rotation arm portion is 90° or less, wherein, when the first lid opens the first through-hole, the angle between the first virtual line and the second virtual line is greater than 90°, wherein the second lid portion includes a second lid formed in a semicircular shape, and a second rotation arm portion having both ends extending in directions opposite to each other about the second rotation shaft and having one of the both ends coupled to the second lid, and a second actuator having an end of a rod rotatably coupled to the other end of the second rotation arm portion, wherein, when the second lid closes the first through-hole, an angle between a third virtual line formed by extending the rod of the second actuator and a fourth virtual line formed by extending the second rotation arm portion is 90° or less, and wherein, when the second lid opens the first through-hole, the angle between the third virtual line and the fourth virtual line is greater than 90°.

* * * * *